US008322529B2

(12) United States Patent
Titkos et al.

(10) Patent No.: US 8,322,529 B2
(45) Date of Patent: Dec. 4, 2012

(54) PRODUCT ASSEMBLY WITH HANGER AND SHRINK WRAP COUPLING MEMBER

(75) Inventors: Laszlo Titkos, Shoreview, MN (US); Alex Tetiyevsky, Springfield, NJ (US); Michael Norman, East New Brunswick, NJ (US); Keith C. Cedro, Clifton, NJ (US)

(73) Assignee: Target Brands, Inc., Minneapolis, MN (US)

( * ) Notice: Subject to any disclaimer, the term of this patent is extended or adjusted under 35 U.S.C. 154(b) by 329 days.

(21) Appl. No.: 12/684,729

(22) Filed: Jan. 8, 2010

(65) Prior Publication Data

US 2011/0168597 A1 Jul. 14, 2011

(51) Int. Cl.
*B65D 73/00* (2006.01)

(52) U.S. Cl. ..... 206/497; 206/553; 206/471; 206/806

(58) Field of Classification Search ..... 206/497, 206/553, 466, 471, 806, 379
See application file for complete search history.

(56) References Cited

U.S. PATENT DOCUMENTS

| | | | | |
|---|---|---|---|---|
| 3,023,554 | A * | 3/1962 | Hlavacek et al. | 53/399 |
| 3,370,733 | A | 2/1968 | Giesler | |
| 3,764,002 | A | 10/1973 | Spiegel et al. | |
| 3,880,283 | A | 4/1975 | Flaherty et al. | |
| 3,885,667 | A | 5/1975 | Spiegel et al. | |
| 3,891,090 | A | 6/1975 | Spiegel et al. | |
| D235,738 | S | 7/1975 | Flaherty | |
| 3,908,827 | A | 9/1975 | Bemmels et al. | |
| 4,053,050 | A | 10/1977 | Forbes, Jr. et al. | |
| 4,166,532 | A | 9/1979 | Tsuchida et al. | |
| 4,307,804 | A | 12/1981 | Benham | |
| D278,604 | S | 4/1985 | Van Zandt | |
| D278,982 | S | 5/1985 | Van Zandt | |
| 4,764,028 | A | 8/1988 | Wood et al. | |
| 5,020,669 | A * | 6/1991 | Nakagoshi | 206/466 |
| 5,117,976 | A | 6/1992 | Whitt et al. | |

(Continued)

FOREIGN PATENT DOCUMENTS

GB 2129758 A 5/1984

(Continued)

OTHER PUBLICATIONS

"An Innovative Solution for Protecting Eyewear," B&G International, Inc., 2007, 1 page.

*Primary Examiner* — J. Gregory Pickett
*Assistant Examiner* — Ernesto Grano
(74) *Attorney, Agent, or Firm* — Griffiths & Seaton PLLC

(57) ABSTRACT

A hanger assembly for supporting an item suspended from a support structure includes a hanger and a sleeve. The hanger includes a display section, which defines a bottom edge and including a hanging feature configured to receive a portion of the support structure, and a drop section extending downwardly from the display section. The drop section includes a primary shaft and an arm. The primary shaft extends the length of the drop section and defines a front surface configured to be placed adjacent the item. The arm extends upwardly from a lower portion of the drop section to define a lower slot between the primary shaft and the arm. The sleeve extends entirely around the primary shaft through the lower slot. The sleeve is initially loose around the primary shaft and is configured to shrink to tightly fit around and secure the item to the primary shaft.

18 Claims, 11 Drawing Sheets

U.S. PATENT DOCUMENTS

| | | | | |
|---|---|---|---|---|
| 5,452,802 | A | 9/1995 | Green | |
| 5,484,056 | A * | 1/1996 | Wood | 206/349 |
| 5,979,652 | A * | 11/1999 | Rosler | 206/481 |
| 6,024,213 | A | 2/2000 | Bush et al. | |
| 6,241,092 | B1 * | 6/2001 | Vasudeva | 206/349 |
| 6,330,758 | B1 | 12/2001 | Feibelman | |
| 6,401,924 | B1 | 6/2002 | Fresnel | |
| 6,425,482 | B1 * | 7/2002 | Chiang | 206/349 |
| 6,637,591 | B2 * | 10/2003 | Chen | 206/349 |
| 6,834,767 | B1 * | 12/2004 | Lin | 211/70.6 |
| D527,634 | S | 9/2006 | Liebers | |
| 7,175,151 | B2 * | 2/2007 | Chang | 248/689 |
| 7,321,308 | B1 | 1/2008 | Feibelman | |
| 7,392,902 | B2 * | 7/2008 | Chang | 206/349 |
| 7,624,865 | B2 * | 12/2009 | Pendergraph et al. | 206/379 |
| 2005/0252870 | A1 * | 11/2005 | Roesler | 211/69 |

FOREIGN PATENT DOCUMENTS

| | | |
|---|---|---|
| JP | 08-198245 | 8/1996 |

* cited by examiner

PRODUCT ASSEMBLY WITH HANGER AND SHRINK WRAP COUPLING MEMBER

BACKGROUND OF THE INVENTION

Retailers are continually evolving product displays in hopes of discovering more effective and visually attractive means for displaying products to potential consumers. The packaging for products may be designed to facilitate product display. For example, given the limited shelf space available in retail stores, it is often desirable to provide product packaging configured to facilitate hanging of products from rods, pegs, or other display fixture support members.

SUMMARY OF THE INVENTION

One aspect of the present invention relates to a hanger assembly for supporting an item suspended from a support structure including a hanger and a sleeve. The hanger includes a display section, which defines a bottom edge and including a hanging feature configured to receive a portion of the support structure, and a drop section extending downwardly from the bottom edge of the display section to define a lower portion of the drop section opposite the bottom of the display section. The drop section includes a primary shaft and an arm. The primary shaft extends the length of the drop section and defines a front surface configured to be placed adjacent the item to be supported. The arm extends upwardly from the lower portion of the drop section laterally spaced from the primary shaft to define a lower slot between the primary shaft and the arm. The sleeve extends entirely around the primary shaft through the lower slot. The sleeve is initially loose around the primary shaft and is configured to shrink upon exposure to an activating condition around the primary shaft and to tightly fit around and secure the item to the primary shaft. Other related products, assemblies and methods are also disclosed and provide additional advantages.

BRIEF DESCRIPTION OF THE DRAWINGS

Embodiments of the invention will be described with respect to the figures, in which like reference numerals denote like elements, and in which.

DETAILED DESCRIPTION

The following detailed description of the invention merely provides example embodiments and is not intended to limit the invention or the application and uses of the invention. Furthermore, there is no intention to be bound by any theory presented in the preceding background of the invention or the following detailed description of the invention.

Embodiments of the present invention are configured to present products for retail sale suspended from a support rod or similar structure. In particular, the hanger, such as a single piece hanger, is configured to fit along side an item for retail sale and secured to one another via a shrink-wrap sleeve extending around a portion of both the hanger and the item for retail sale. In one example, the hanger provides a display portion including information regarding the item for retail sale and a drop portion downwardly extending from the display portion. A portion of the item for retail sale, e.g., a handle of a kitchen utensil, is placed to longitudinally extend in parallel and in contact with the drop portion. The shrink-wrap sleeve is placed around the drop portion and the handle of the kitchen utensil and is exposed to conditions that shrink the shrink-wrap sleeve thereby securing the utensil to the hanger. The entire assembly is suspended via the hanger from a retail display support rod or other support. When hung, the display portion can be easily read, etc. by potential consumers and other viewers thereof. Additional details and variations are described in the below description.

Figure 1:
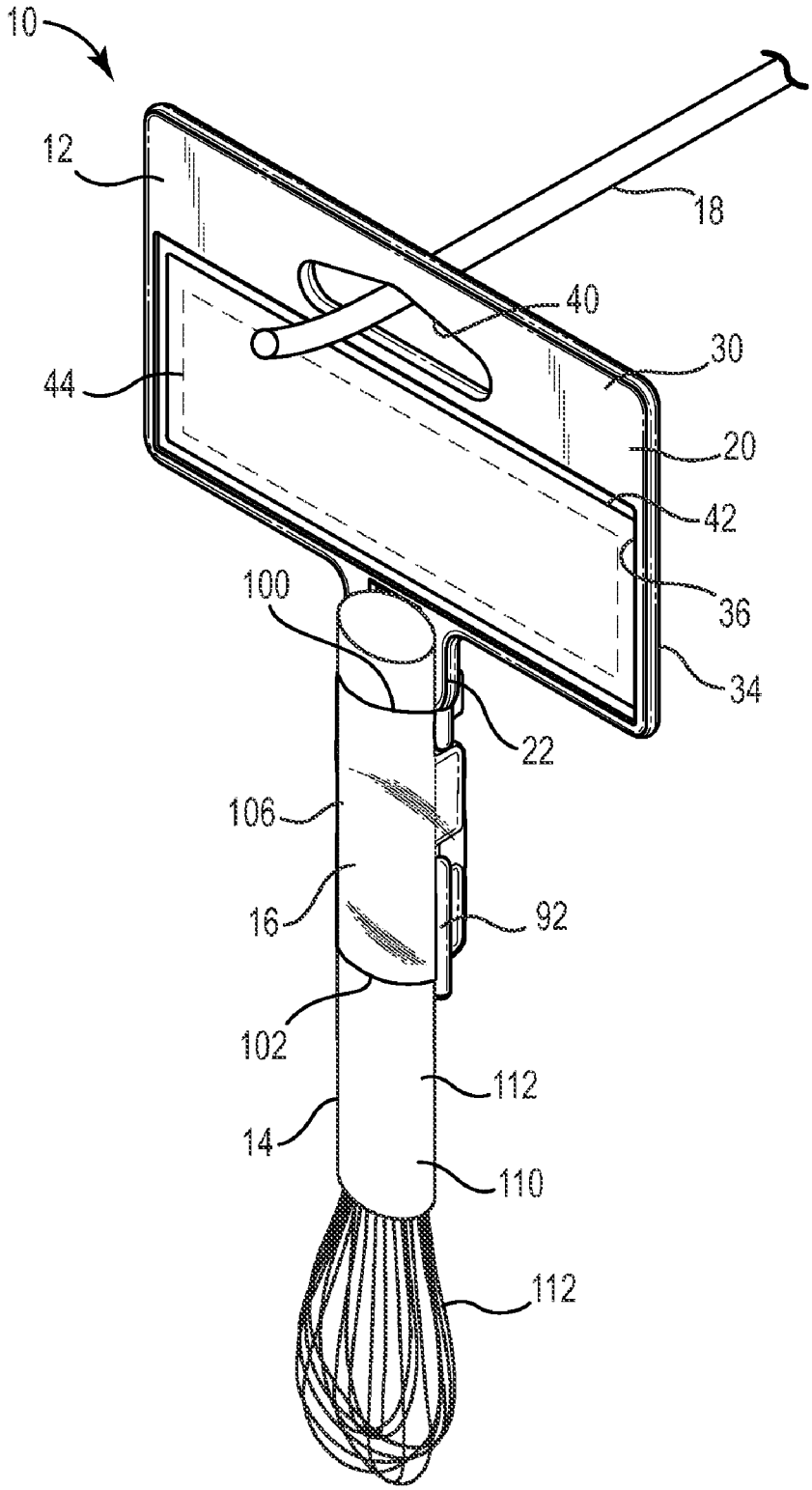
FIG. 1 is a front, perspective view illustration of a retail display including a product assembly comprising a hanger and an item for retail sale, according to one embodiment of the present invention.
Figure 2:
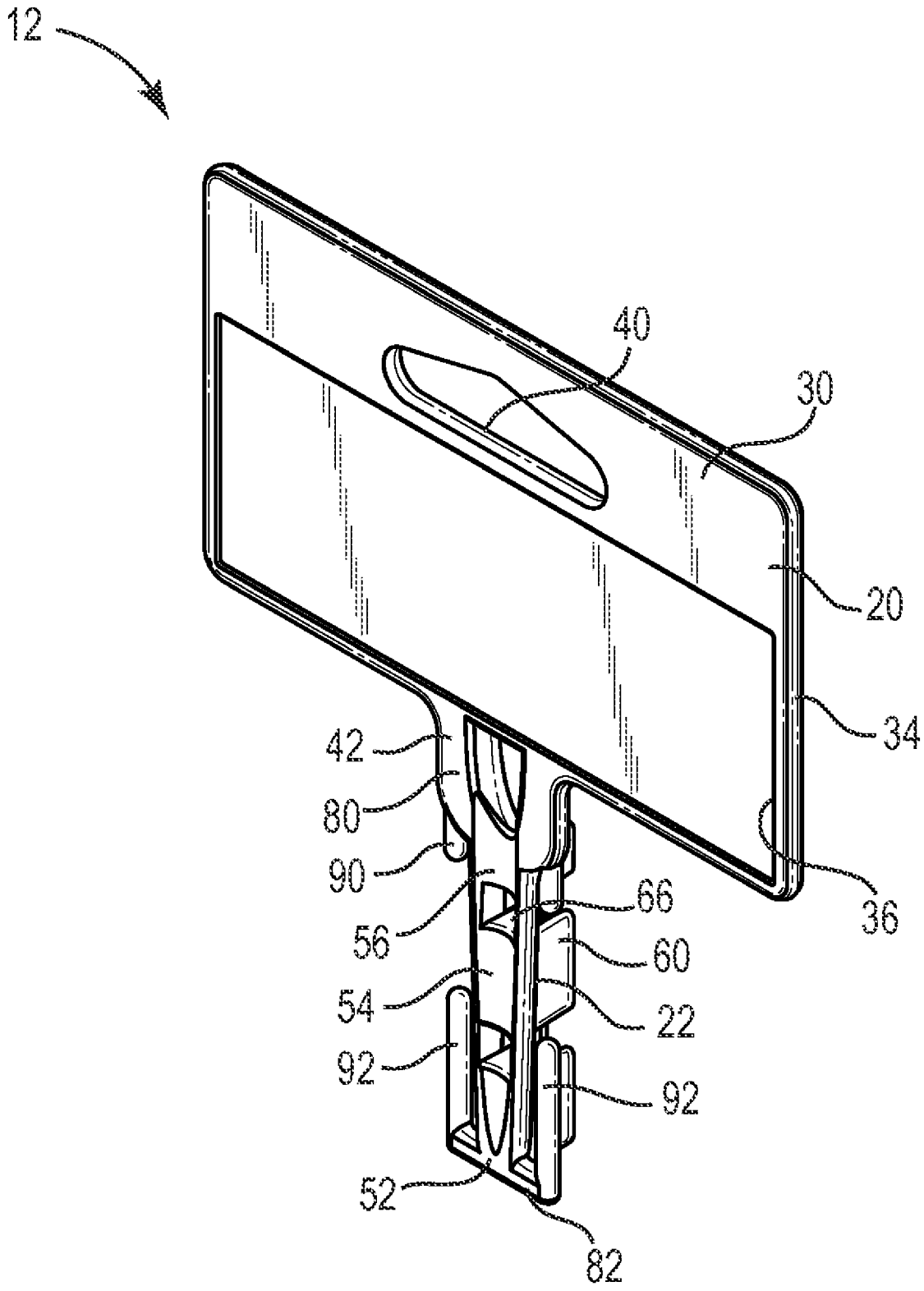
FIG. 2 is a front perspective view illustration of a hanger of the hanger assembly of FIG. 1, according to one embodiment of the present invention.
Figure 3:
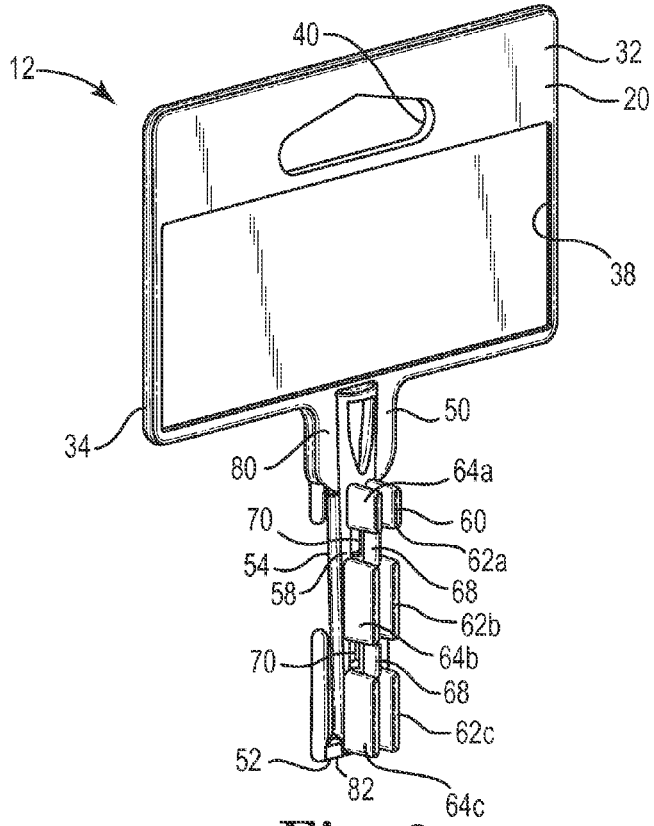
FIG. 3 is a rear perspective view illustration of the hanger of FIG. 2, according to one embodiment of the present invention.
Figure 4:
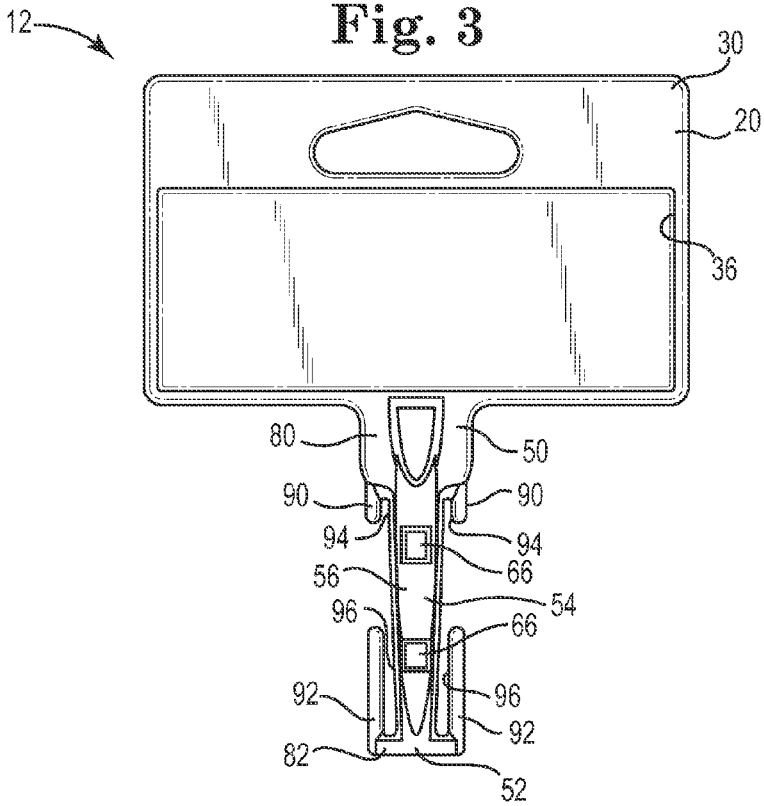
FIG. 4 is a front view illustration of the hanger of FIG. 2, according to one embodiment of the present invention.
Figure 5:
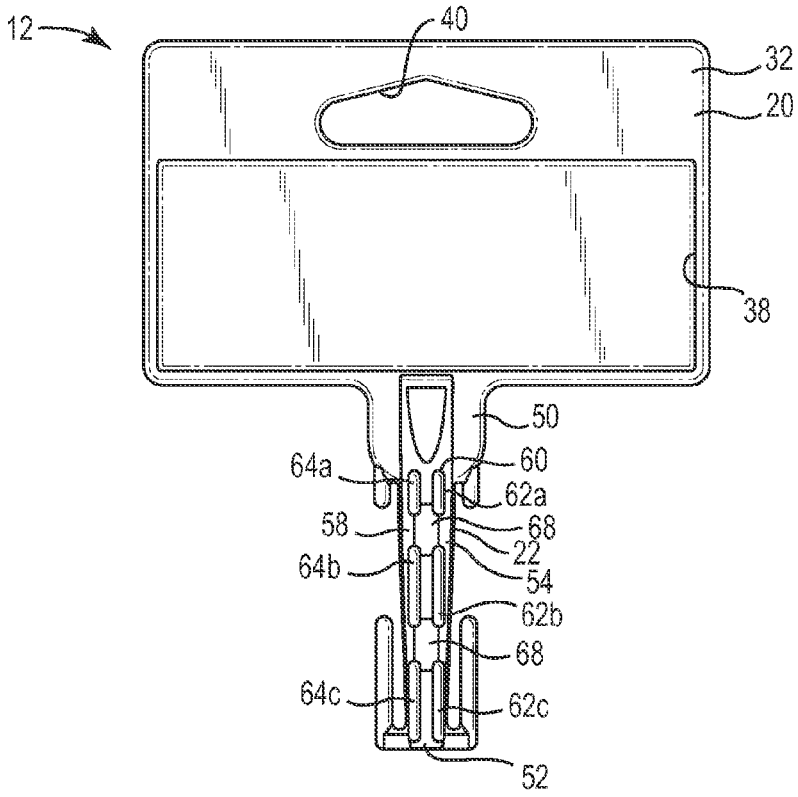
FIG. 5 is a rear view illustration of the hanger of FIG. 2, according to one embodiment of the present invention.
Figure 6:
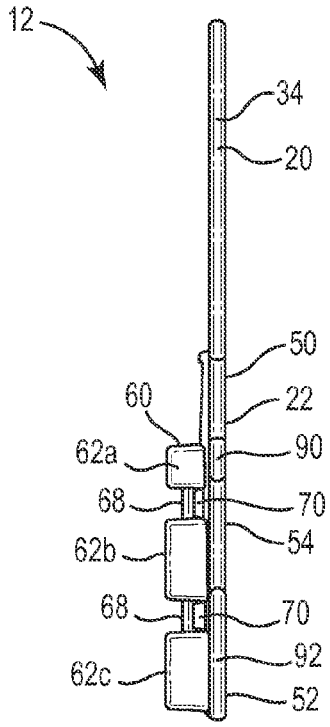
FIG. 6 is a right side view illustration of the hanger of FIG. 2, according to one embodiment of the present invention with the left side view being a mirror image of the right side view.
Figure 7:
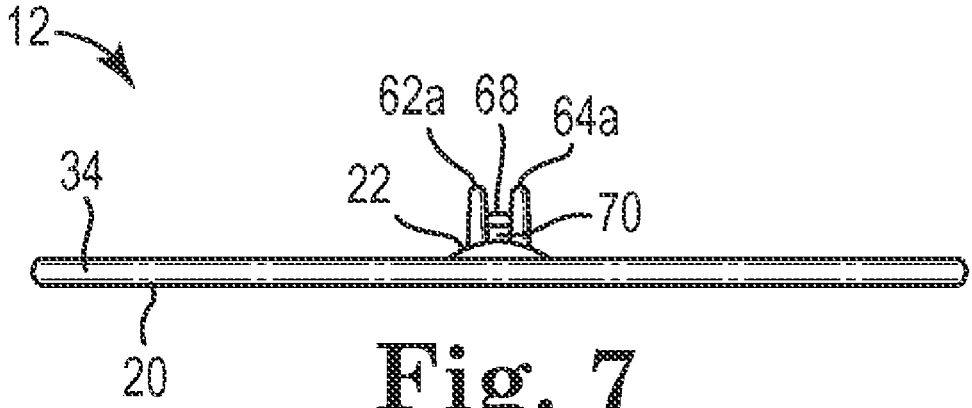
FIG. 7 is a top view illustration of the hanger of FIG. 2, according to one embodiment of the present invention.
Figure 8:
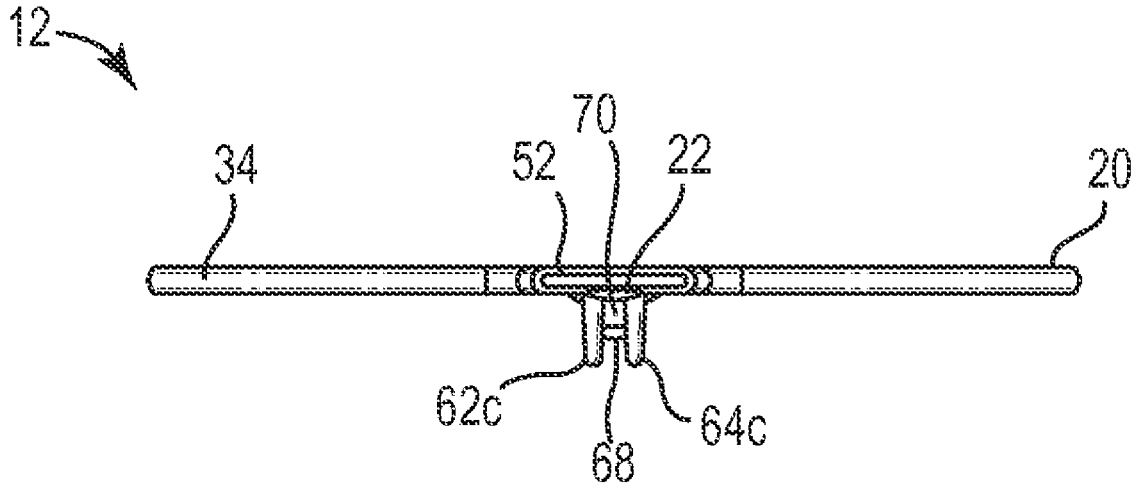
FIG. 8 is a bottom view illustration of the hanger of FIG. 2, according to one embodiment of the present invention.

Turning to FIG. 1, in one embodiment, a product assembly 10 is provided including hanger 12, a utensil 14 or other suitable item for retail sale, and a shrink-wrap sleeve 16. In one example, product assembly 10 is hung from a retail support rod 18 or other display rod as part of a display assembly in a retail or other store. In particular, sleeve 16 secures utensil 14 to hanger 12, and hanger 12 is hung from retail support rod 18.

One embodiment of hanger 12 is illustrated in FIGS. 2-8. In one example, hanger 12 includes a card or display section 20 and a support arm or drop section 22. Display section 20 defines a front surface 30 and a rear surface 32 opposite front surface 30. For example, display section 20 is substantially planar such that front surface 30 and rear surface 32 are broad in comparison to a thickness of display section 20 defined between front surface 30 and rear surface 32. Display section 20 defines a perimeter edge 34 between front surface 30 and rear surface 32. In one example, display section 20 and therefore, front surface 30, rear surface 32, and perimeter edge 34, are each substantially rectangular although use of other suitable shapes is also contemplated.

In one example, front surface 30 is substantially planar, but defines a front recess or front indentation 36 rearwardly inset from a remainder of front surface 30, but not through an entire thickness of display section 20. Front indentation 36 may be used for any suitable purpose, and, in one embodiment, provides a portion of front surface 30 configured to receive a label 42 (FIG. 1) or other member configured to present instructional, promotional, or other indicia 44 (generally indicated with a dashed box in FIG. 1) configured to inform consumers about, instruct consumers regarding how to use, promote the sale of, or otherwise describe utensil 14. In one example, rear surface 32 defines a rear recess or rear indentation 38 forwardly inset from a remainder of rear surface 32 similar to how but in an opposite direction as compared to how front indentation 36 extends from front surface 30. Rear indention 38 is configured to receive another label 42 with indicia 44 (see FIG. 9) in a similar manner as described with respect to front indentation 36. In one embodiment, display section 20 includes only one of or both of front indentation 36 and rear indentation 38.

Display section 20 defines a hanging aperture 40 or other hanging feature or mechanism for receiving a suitable support, for example, a retail support rod 18, such that hanger 12 is suspended therefrom (e.g., other means for receiving a support). Other means for supporting hanger 12 in a suspended position include a hook, a notch, a protrusion, etc. as will be apparent to those of skill in the art upon reading the present application.

In one embodiment, drop section 22 extends downwardly from a bottom-most portion of perimeter edge 34 of display section 20 in an elongated manner defining a first end 50 immediately adjacent display section 20 and a second edge 52 opposite first end 50. In one example, display section 20 is substantially broader in at least one direction (e.g., a lateral direction) than drop section 22. More specifically, in one example, drop section 22 includes a primary shaft 54 (e.g., an longitudinally portion) substantially extending the entire length of drop section 22 between first end 50 and second end 52. Primary shaft 54 is shaped in a suitable manner, for example, to define a first or front surface 56 and a second or rear surface 58 opposite front surface 56. In one embodiment, front surface 56 is laterally contoured to match the cross-sectional contour of the portion of item 14 for retail sale. For instance, where item 14 is a utensil with a substantially cylindrical handle, front surface 56 is curved such that the handle is able to nest with front surface 56 of primary shaft 54.

In one example, protrusions 60 are formed and extend rearwardly from rear surface 58 of primary shaft 54. For instance, a first series of elongated protrusions 62*a*, 62*b*, and 62*c* are longitudinally spaced along a left side of primary shaft 54 and a second series of elongated protrusions 64*a*, 64*b*, and 64*c* are longitudinally spaced along a right side of primary shaft 54. In one embodiment, first series of elongated protrusions 62*a*, 62*b*, and 62*c* and second series of elongated protrusions 64*a*, 64*b*, and 64*c* mirror each other along primary shaft 54. First series of elongated protrusions 62*a*, 62*b*, and 62*c* and second series of elongated protrusions 64*a*, 64*b*, and 64*c* are spaced from one another to define slots 70 laterally extending therebetween.

More specifically, a first one of slots 70 laterally extends from between two of the first series of elongated protrusions 62*a* and 62*b* to between two of the second series of elongated protrusions 64*a* and 64*b*, and a second one of slots 70 laterally extends from between a different two of the first series of elongated protrusions 62*b* and 62*c* to between a different two of the second series of elongated protrusions 64*b* and 64*c*. In one embodiment, hanger 12 includes a bridge member 68 extending over each one of slots 70, e.g., between two of first series of elongated protrusions 62*a* and 62*b* or 62*b* and 62*c* and two of second series of elongated protrusions 64*a* and 64*b* or 64*b* and 64*c* such that each slot 70 is defined in front of a corresponding bridge member 68. In one example, bridge members 68 are only supported by corresponding ones of protrusions 60; while in one example, bridge members 68 are supported from rear surface 58 of primary shaft 54 in addition to or as an alternative to their interaction with the corresponding ones of the protrusions 60. In one example, holes 66 are defined through primary shaft 54 in front of bridge members 68 to facilitate formation of hanger 12 (e.g., where hanger 12 is injection molded), to decrease a weight of hanger 12, and/or to decrease an amount of material used to form hanger 12.

In one example, drop section 22 forms a widening 80 near first end 50 and a widening 82 near second end 52. In other words, drop section 22 is wider near each of first end 50 and second end 52 than at a middle section of drop section 22 (e.g., primary shaft 54 of drop section 22). A top prong or top arm 90 downwardly extends (e.g., extends away from display section 20) from each of left and right sides of widening 80 spaced from primary shaft 54 to define corresponding top slots 94 between each top arm 90 and primary shaft 54. Similarly, a bottom prong or bottom arm 92 upwardly extends (e.g., extends toward display section 20) from each of left and right sides of widening 82 to define corresponding bottom slots 96 between each bottom arm 92 and primary shaft 54. In one embodiment, bottom arms 92 are longer than top arms 90; however, the reverse sizing or identical sizing of top arms 90 and bottom arms 92 is also contemplated.

In one embodiment, sleeve 16 is a closed tube configured to shrink under exposure to certain activating elements or conditions, such as heat, vacuum pressure, etc. In one example, sleeve 16 is a heat-shrink tube, such as a tube formed of transparent, translucent, or opaque plastic as will be apparent to those of skill in the art upon reading the present application, configured to shrink and/or harden when heat, such as heat from a heat gun, is applied to sleeve 16. Sleeve 16 is closed and defines a top edge 100 and a bottom edge 102 opposite top edge 100. As such, sleeve 16 defines a continuous inner surface 104 and a continuous outer surface 106. A length of sleeve 16 as defined between top edge 100 and bottom edge 102 is less than a distance between far edges of one of top slots 94 and a corresponding bottom slot 96 (i.e., a bottom slot 96 on a similar side of primary shaft 54).

In one embodiment, utensil 14 includes a kitchen utensil, a cleaning utensil, a hairbrush, etc. and/or may be replaced with any other suitably sized and shaped item for retail sale. For instance, items having elongated relatively narrow portions are particularly suitable for use (e.g., as utensil 14) with hanger 12 and sleeve 16. In one embodiment, utensil 14 includes a handle 110 extending from a functional or other portion 112 thereof. During use, sleeve 16 is placed around primary shaft 54, more particularly, such that top edge 100 is positioned to extend through both top slots 94 and bottom edge 102 is positioned to extend through both bottom slots 96. Sleeve 16 is sized to allow handle 110 to be readily slid alongside primary shaft 54 within sleeve 16 as generally illustrated with reference to FIG. 9. For example, handle 110 defines an external surface 114 placed adjacent front surface 30 of primary shaft 54 and adjacent inside surface 104 of sleeve. Once positioned as desired (e.g., such that top of handle 110 is level with or just below a bottom of perimeter edge 34 of display section 20), heat is applied to sleeve 16, which shrinks sleeve 16 until sleeve 16 is tightly secured to and compressed around handle 110 of item 14 and primary shaft 54. As a result, item 14 is securely coupled with hanger 12 and can be suspended from support rod 18 via hanger 12.

Figure 9:
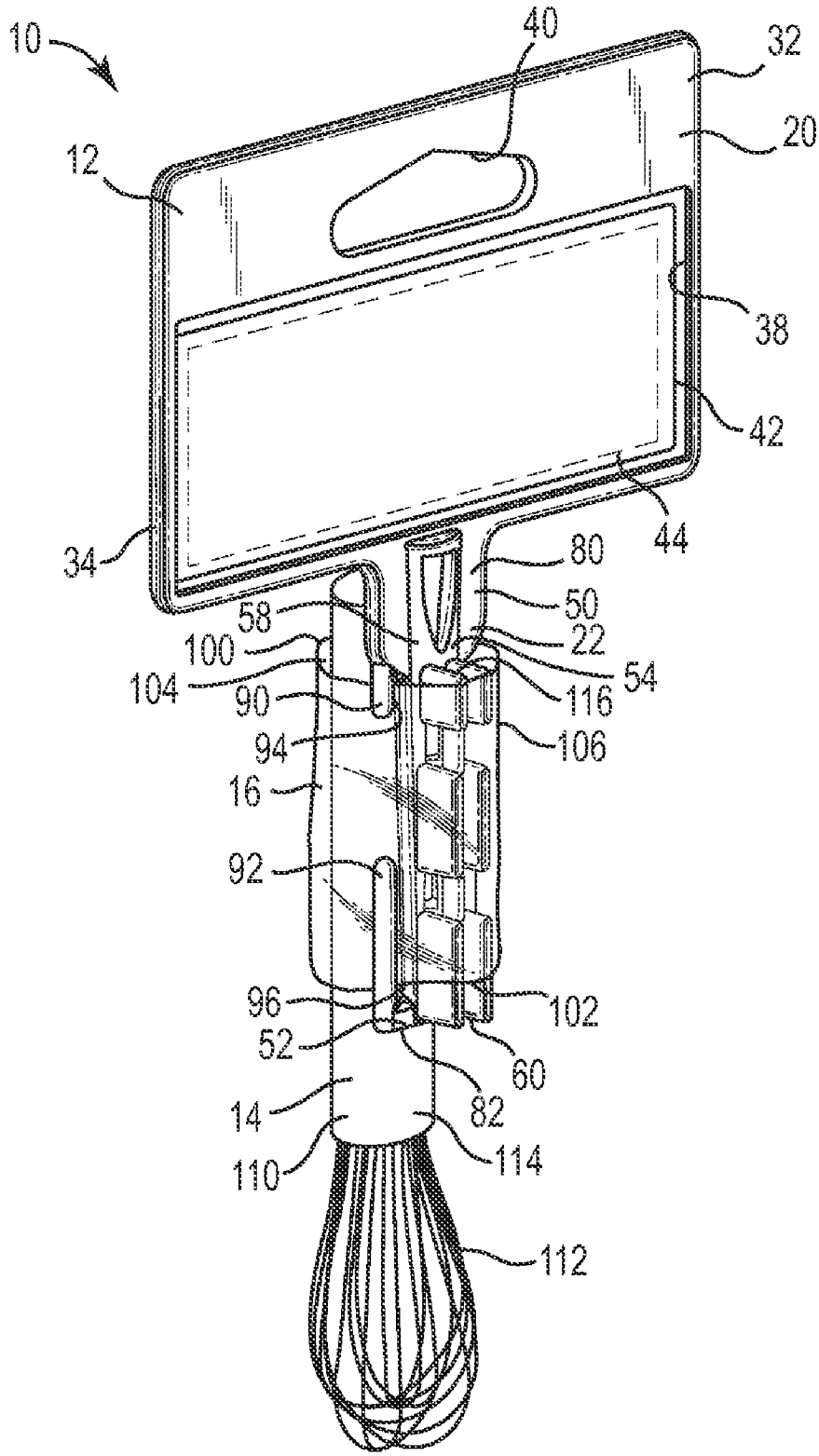
FIG. 9 is a rear perspective view illustration of the product assembly of FIG. 1, according to one embodiment of the present invention.
Figure 10:
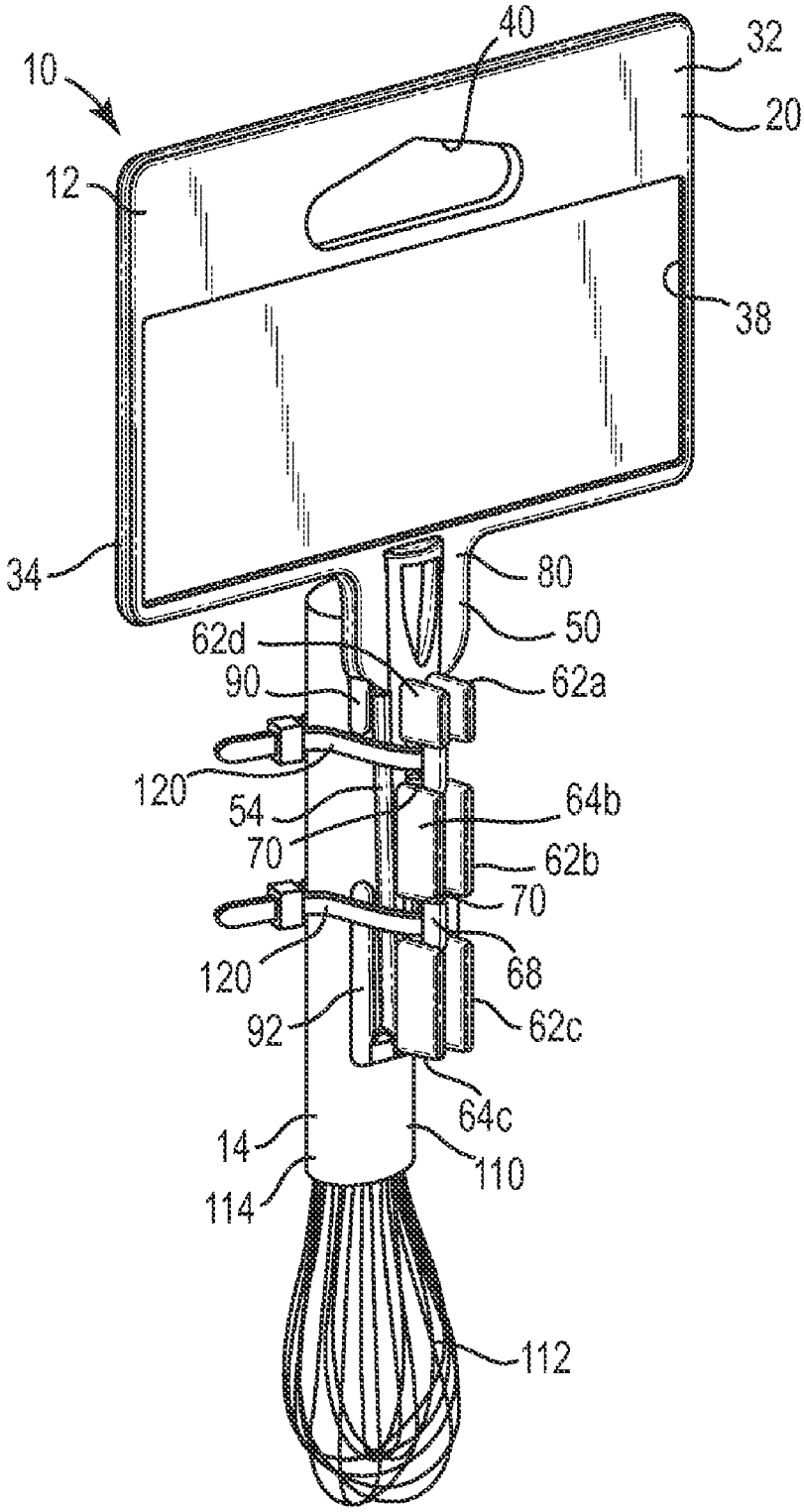
FIG. 10 is a rear perspective view illustration of a product assembly, according to one embodiment of the present invention.
Figure 11:
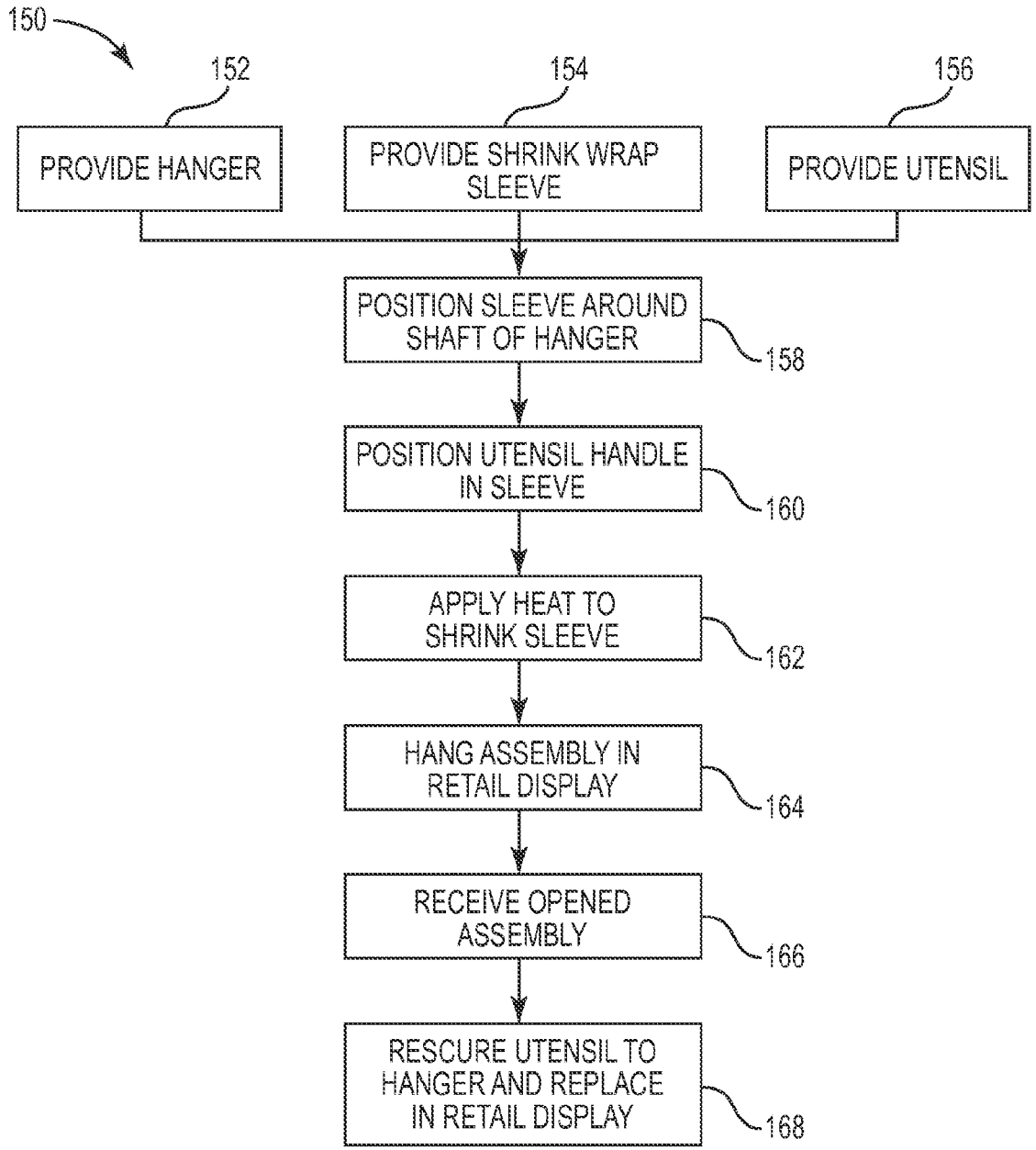
FIG. 11 is a flow chart illustrating a method of forming a product assembly, according to one embodiment of the present invention.
Figure 12:
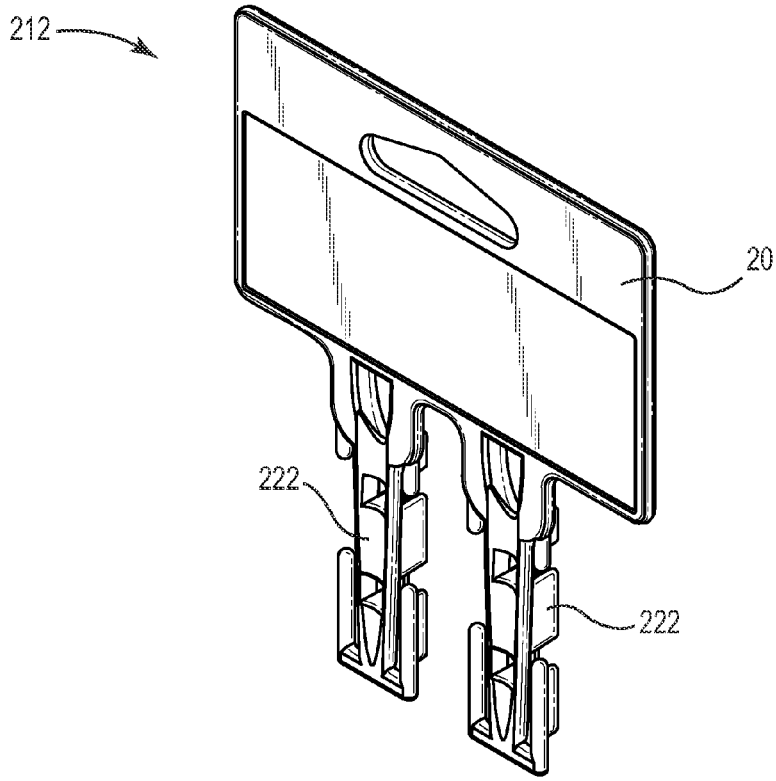
FIG. 12 is a front perspective view illustration of a hanger, according to one embodiment of the present invention.
Figure 13:
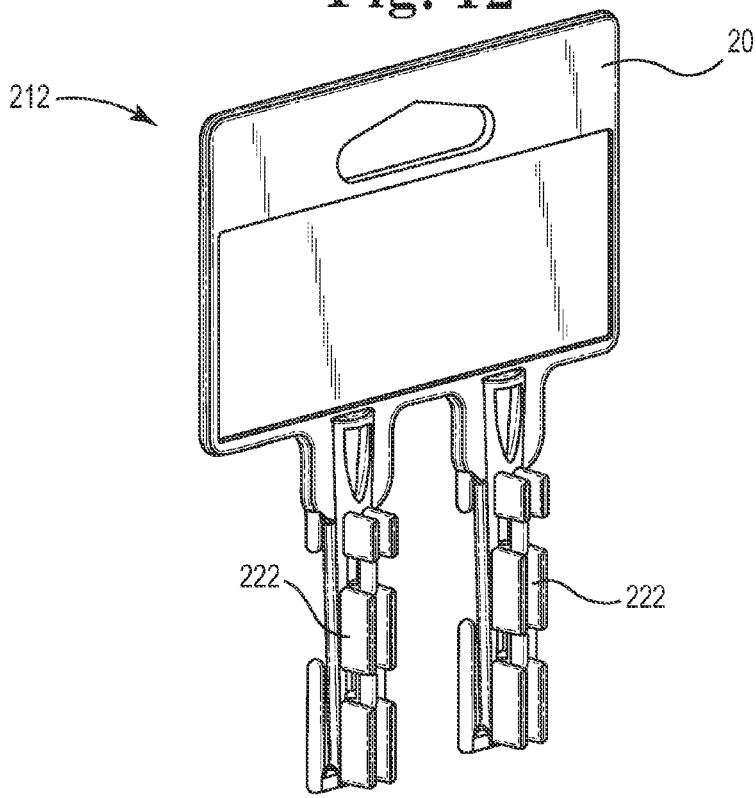
FIG. 13 is a rear perspective view illustration of the hanger of FIG. 12, according to one embodiment of the present invention.
Figure 14:
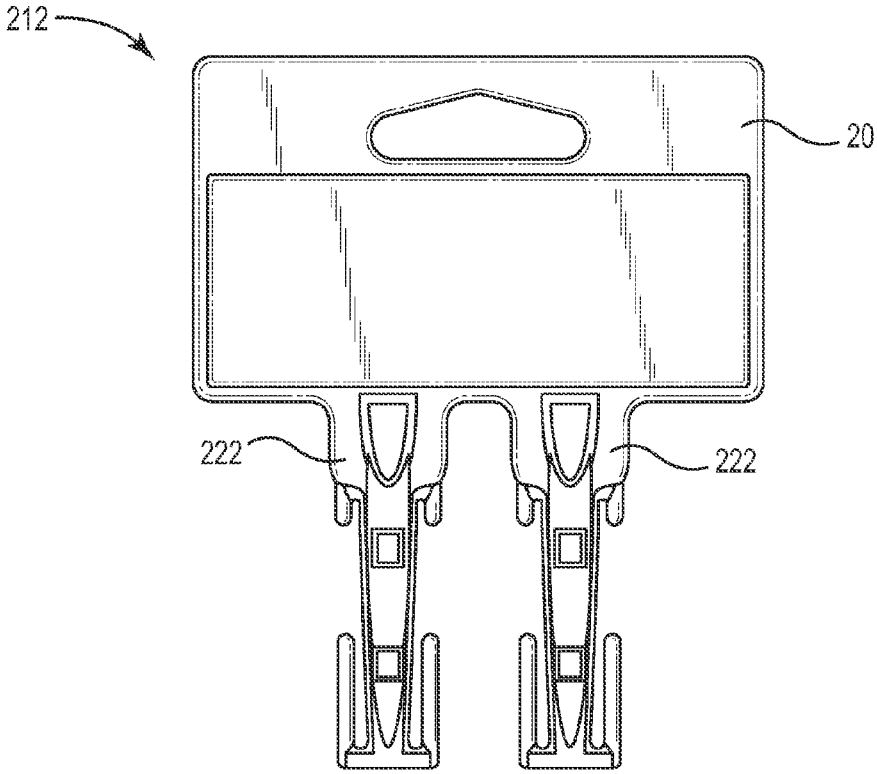
FIG. 14 is a front view illustration of the hanger of FIG. 12, according to one embodiment of the present invention.
Figure 15:
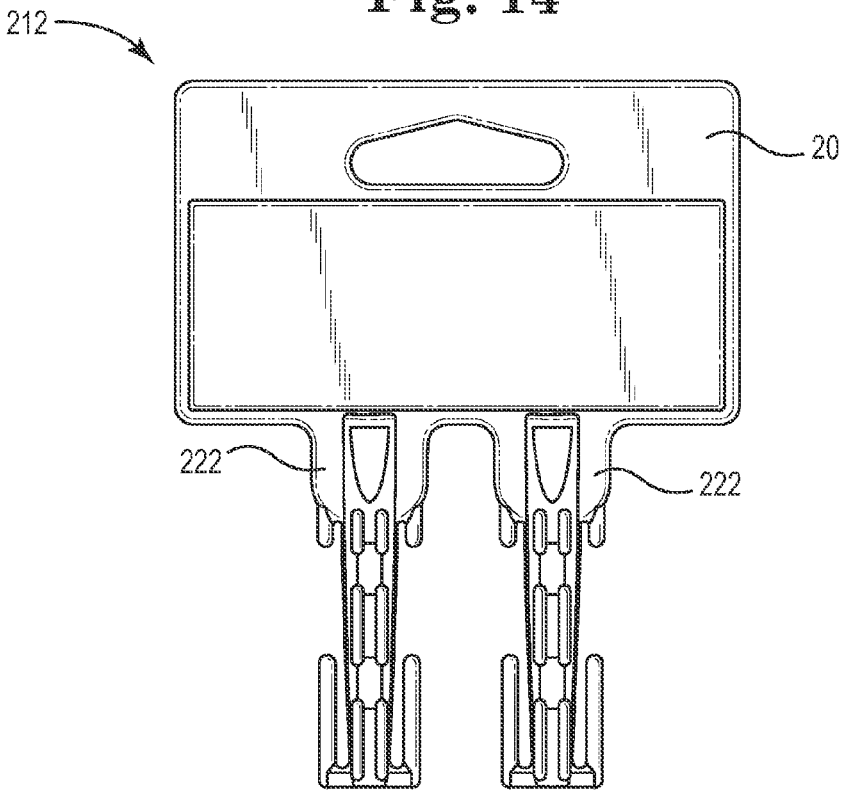
FIG. 15 is a rear view illustration of the hanger of FIG. 12, according to one embodiment of the present invention.
Figure 16:
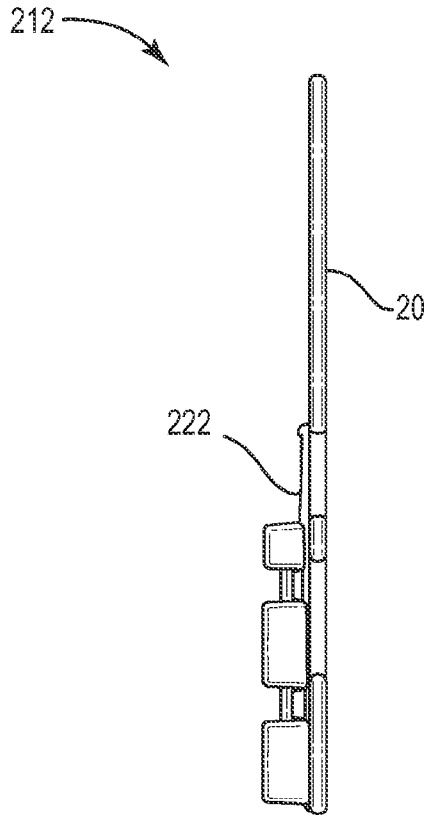
FIG. 16 is a right side view illustration of the hanger of FIG. 12, according to one embodiment of the present invention with the left side view being a mirror image of the left side view.
Figure 17:
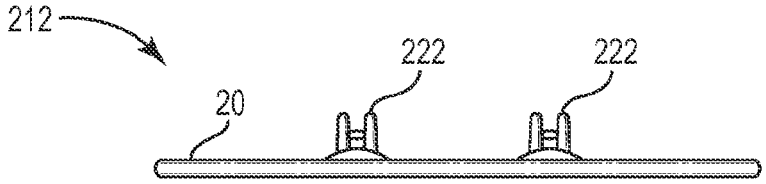
FIG. 17 is a top view illustration of the hanger of FIG. 12, according to one embodiment of the present invention.
Figure 18:
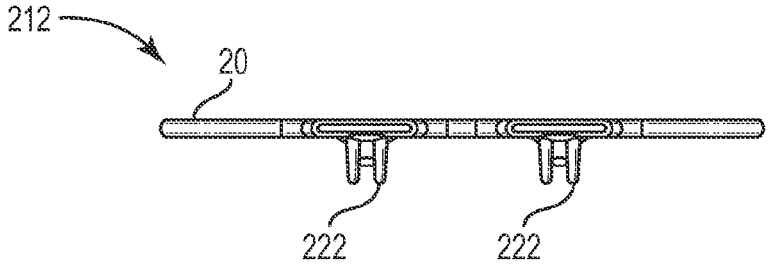
FIG. 18 is a bottom view illustration of the hanger of FIG. 12, according to one embodiment of the present invention.

FIG. 11 generally illustrates one example of a method 150 of forming product assembly 10. At 152, 154, and 156, hanger 12, sleeve 16, and utensil 14 are provided, for example, as described in detail above. At 158, sleeve 16 is slid over primary shaft 54 of hanger 12 in a manner placing top edge 100 of sleeve 16 into top slot 94 between primary shaft 54 and each of top arms 90. Sleeve 16 is sufficiently flexible to allow it to flex slightly such that bottom edge 102 of sleeve 16 can be positioned into slots 96 between primary shaft 54 and each of bottom arms 92 as generally illustrated in FIG. 9. Once positioned, longitudinal movement of sleeve 16 relative to hanger 12 is constrained. More specifically, interaction between top edge 100 of sleeve 16 and a closed end of top slot 94 (e.g., a second end 52 of drop section 22) limits upward movement of sleeve 16, and interaction between bottom edge 102 of sleeve 16 and a closed end of bottom slot 96 (e.g., a first end 50 of drop section 22) limits downward movement of sleeve 16.

At 160, handle 110 of utensil 14 is slid into sleeve 16 adjacent front surface 56 such that handle 110 nests within a curvature of (whether smooth curvature or angular bending of) front surface 56 of primary shaft 54. In one example, handle 110 is positioned such that a top thereof is near or aligned with a top of primary shaft 54.

Once handle 110 is positioned as desired with respect to hanger 12 and sleeve 16, then, at 162, product assembly 10, more specifically, sleeve 16 is exposed to a heat or other specific exposure (e.g., vacuum pressure) application causing sleeve 16 to shrink until sleeve 16 tightly wraps primary shaft 54 and handle 110 as a tight outer skin. In one embodiment, when shrunk, sleeve 16 contacts each protrusion 60 and extends between first series of elongated protrusions 62*a*, 62*b*, and 62*c* and second series of elongated protrusions 64*a*, 64*b*, and 64*c*. protrusions 60 in generally provide additional structure that sleeve 16 surrounds, and, in one embodiment, thereby, contributes to maintenance of sleeve 16 on hanger 12 (e.g., helps prevent sleeve 16 from longitudinally slipping from its desired position on hanger 12).

In one example, the spacing between first series of elongated protrusions 62*a*, 62*b*, and 62*c* and second series of elongated protrusions 64*a*, 64*b*, and 64*c* provides a cut channel 116 (FIG. 9) to facilitate subsequent removal of utensil 14 from hanger 12. In particular, the spacing between first series of elongated protrusions 62*a*, 62*b*, and 62*c* and second series of elongated protrusions 64*a*, 64*b*, and 64*c* provides cut channel 116 where a scissors, knife, blade, etc. can be more easily be inserted to contact an inside surface 104 of sleeve 16 and to cut sleeve 16 along a longitudinal length thereof such that utensil 14 is released from hanger 12 and can be used for its specified purpose(s). In one example, protrusions 60 hold sleeve 16 slightly away from rear surface 58 of primary shaft 54 to allow a knife, etc. to be more easily inserted between hanger 12 and sleeve 16, e.g., in cut channel 116, to slice sleeve 16 for removal. In one embodiment, sleeve 16 may be perforated or otherwise formed with indicia, etc. indicating where sleeve 16 is configured to be cut, for example, along cut channel 116, to remove hanger 12 from utensil 14.

At 164, after sleeve 16 is shrunk but before a knife, etc. is applied to cut sleeve 16, hanger 12 is hung on support rod 18, for example, is positioned to receive support rod 18 via hanging aperture 40 in a desired position within a retail store. When so hung, utensil 14 is suspended for display to potential consumers and for subsequent removal from support rod 18, purchase, and removal from the retail setting.

In one embodiment, sleeve 16 may be damaged or a consumer who purchased utensil 14 may return utensil 14 after having cut sleeve 16 such that the retail store receives an opened or partially disassembled product assembly 10 at 166. In one example, at 168, utensil 14 is re-secured to hanger 12 using a method other than sleeve 16 or similar structures, which are not generally available in stores for repackaging merchandise. In one embodiment, ties 120, such as cable ties, string, etc., are placed to extend through transverse slots 70 and around primary shaft 54 of hanger 12 and handle 110 of utensil 14 such that utensil 14 is securely coupled with hanger 12 in a relatively aesthetically pleasing manner that can be placed back in the retail display without conspicuous signs of repackaging, etc. Notably, although the locking portion of ties 120 are illustrated in one position, it should be understood that such ties could be located closer to primary shaft 154 and/or in any other suitable position.

FIGS. 12-18 illustrate one embodiment of a hanger 212. Hanger 212 is similar to hanger 12 described above except that two separate drop sections 222 downwardly extend from a bottom edge of display section 20. In one embodiment, each drop section 222 is substantially similar to drop section 22 described above and is configured to receive a utensil 14 and sleeve 16 in a similar manner as described with respect to drop section 22. In this manner, two or more utensils (e.g., one utensil from each drop section 222) are secured to hanger 212 and collectively are hung on support rod 18 via hanger 212. Those of skill in the art will realize that other numbers drop sections 22 or 222 may be included on a single hanger 12 or 212.

Although the invention has been described with respect to particular embodiments, such embodiments are for illustrative purposes only and should not be considered to limit the invention. Various alternatives and modifications within the scope of the invention in its various embodiments will be apparent to those with ordinary skill in the art.

What is claimed is:

1. A hanger assembly for supporting an item suspended from a support structure, the hanger assembly comprising:

a hanger including:

a display section defining a bottom edge and including a hanging feature configured to receive a portion of the support structure, and a drop section extending downwardly from the bottom edge of the display section to define a lower portion of the drop section opposite the bottom edge of the display section, the drop section including:

a primary shaft extending along a length of the drop section, wherein the primary shaft defines a front surface configured to be placed adjacent the item to be supported, and an arm extending upwardly from the lower portion of the drop section laterally spaced from the primary shaft to define a lower slot between the primary shaft and the arm, wherein the lower slot is open at a top and closed at a bottom thereof; and a sleeve extending entirely around the primary shaft and through the lower slot, wherein the sleeve is initially loose around the primary shaft and is configured to shrink upon exposure to an activating condition to tightly fit around and secure the item to the primary shaft.

2. The hanger assembly of claim 1, wherein the activating condition is heat.

3. The hanger assembly of claim 1, wherein:

the arm is a first arm, the lower slot is a first lower slot and is open at a top and closed at a bottom thereof, the drop section includes a second arm extending upwardly from the lower portion of the drop section laterally spaced from the primary shaft and opposite the first arm to define a second lower slot between the primary shaft and the second arm, the second lower slot is open at a top and closed at a bottom thereof, and the sleeve extends entirely around the primary shaft and through the second lower slot.

4. The hanger assembly of claim 3, wherein:

the drop section includes:

a third arm extending downwardly on a side of the primary shaft laterally aligned with the first arm and spaced from the primary shaft to define an upper slot between the third arm and the primary shaft, the upper slot being open at a bottom and closed at a top thereof, and the sleeve is positioned to extend through the upper slot.

5. The hanger assembly of claim 4, wherein:

the primary shaft defines a rear surface opposite the front surface, the drop section includes a plurality of protrusions each extending rearwardly from the rear surface to define a cut channel longitudinally extending between ones of the plurality of protrusions, the cut channel being configured to allow a cutting mechanism to readily be placed within the cut channel between the sleeve and the rear surface to cut the sleeve, the drop section defines laterally extending slots each formed between at least two of the plurality of protrusions, the laterally extending slots being configured to receive ties for securing and extending around the item to the primary shaft should the sleeve be compromised, and the sleeve extends around each of the plurality of protrusions and the primary shaft.

6. The hanger assembly of claim 1, wherein:

the arm is a first arm, the lower slot is open at a top and closed at a bottom thereof;

the drop section includes:

a second arm extending downwardly on a side of the primary shaft laterally aligned with the first arm and spaced from the primary shaft to define an upper slot between the second arm and the primary shaft, the upper slot being open at a bottom and closed at a top thereof, and the sleeve is positioned to extend through the upper slot.

7. The hanger assembly of claim 1, wherein the display section is broad in comparison to the drop section in one direction.

8. The hanger assembly of claim 1, wherein:

the primary shaft defines a rear surface opposite the front surface, the drop section defines a plurality of protrusions each extending rearwardly from the rear surface of the primary shaft, and the sleeve extends around each of the plurality of protrusions and the primary shaft.

9. The hanger assembly of claim 8, wherein a cut channel is defined between the plurality of protrusions allowing a cutting mechanism to readily be placed within the cut channel between the sleeve and the rear surface to cut the sleeve.

10. The hanger assembly of claim 1, wherein:

the primary shaft defines a rear surface opposite the front surface, the drop section defines laterally extending slots positioned on a rear side of the rear surface of the primary shaft, and the laterally extending slots are configured to receive alternative ties to secure the item to the primary shaft if the sleeve is subsequently unavailable.

11. The hanger assembly of claim 10, wherein:

the drop section defines a plurality of protrusions each extending rearwardly from the rear surface of the primary shaft, the laterally extending slots are each defined between at least two of the plurality of protrusions, and the sleeve extends around each of the plurality of protrusions and the primary shaft.

12. The hanger assembly of claim 1, wherein:

the drop section is a first drop section, the hanger includes a second drop section extending downwardly from the bottom edge of the display section, the second drop section being substantially identical to the first drop section, the sleeve is a first sleeve, and the hanger assembly further comprises a second sleeve extending around the second drop section, wherein the second sleeve is initially loose around the second drop section and is configured to shrink upon exposure to an activating condition.

13. The hanger assembly of claim 1, in combination with the item, wherein the item is placed between the front surface of the primary shaft and the sleeve such that when the sleeve is shrunk, the sleeve compresses around the primary shaft and the item securing the item to the hanger.

14. The combination of claim 13, wherein the item in a utensil defining a handle, and the handle of the utensil extends longitudinally along the front surface of the primary shaft.

15. A product assembly comprising:

an article for retail sale;

means for displaying information about the article including means for receiving a support structure to suspend the means for displaying from the support structure;

means for extending along a portion of the article, the means for extending being positioned to extend downwardly from and coupled to the means for displaying;

means for shrinking upon exposure to an activating element, the means for shrinking extending around at least a portion of each of the means for extending and the article to secure the article to the means for extending after the means for shrinking is exposed to the activating element causing the means for shrinking to tightly interact with each of the means for extending and the article;

means for threadably receiving fastening means to alternatively secure the item to the means for extending if the means for shrinking is compromised, wherein the means for threadably receiving is positioned on a side of the means for extending opposite the position of the article on the means for extending;

a bottom prong longitudinally extending and laterally spaced from a bottom portion of the means for extending to define a bottom slot adjacent the bottom prong and the means for extending, wherein the bottom slot has a closed bottom end and an open top end and defines a free top end;

means for spanning between and coupling the bottom prong and the means for extending, the means for spanning defining the closed bottom end of the bottom slot wherein the means for shrinking extends between the bottom prong and the means for extending and is positionally constrained against downward movement along the article by the means for spanning along the closed bottom end of the bottom slot, and the means for shrinking extends between the bottom prong and the means for extending through the bottom slot and extends above both of the open top of the bottom slot and a top of the bottom prong; and a top prong longitudinally extending and laterally spaced from a top portion of the means for extending to define a top slot adjacent each of the top prong and the means for extending, wherein the top prong defines a free bottom end entirely spaced from and laterally aligned with the free top end of the bottom prong, and the top slot has an open bottom end and a closed to end;

wherein the means for shrinking extends through the top slot.

16. The product assembly of claim 15, further comprising means for defining a cut channel and holding the means for shrinking slightly away from the means for extending to facilitate placement of a cutting utensil between the means for shrinking and the means for extending.

17. The product assembly of claim 16, wherein the cut channel is entirely spaced from and extends parallel to the bottom slot.

18. The product assembly of claim 15, wherein means for displaying information about the article is substantially broader than the means for extending in at least one direction.

* * * * *